United States Patent [19]

Matsumura

[11] Patent Number: 4,467,769

[45] Date of Patent: Aug. 28, 1984

[54] CLOSED LOOP AIR/FUEL RATIO CONTROL OF I.C. ENGINE USING LEARNING DATA UNAFFECTED BY FUEL FROM CANISTER

[75] Inventor: Toshimi Matsumura, Obu, Japan

[73] Assignee: Nippondenso Co., Ltd., Kariya, Japan

[21] Appl. No.: 366,388

[22] Filed: Apr. 7, 1982

[30] Foreign Application Priority Data

Apr. 7, 1981 [JP] Japan ..... 56-52016

[51] Int. Cl.[3] ..... F02M 51/00; F02M 25/08

[52] U.S. Cl. ..... 123/489; 123/520

[58] Field of Search ..... 123/519, 520, 438, 440, 123/489

[56] References Cited

U.S. PATENT DOCUMENTS 4,235,204 11/1980 Rice ..... 123/489 X
4,308,842 1/1982 Watanabe et al. ..... 123/520
4,381,753 5/1983 Yuzawa et al. ..... 123/520

FOREIGN PATENT DOCUMENTS 32227 3/1978 Japan ..... 123/520

OTHER PUBLICATIONS

*Research Disclosure*, # 17419, Oct. 1978, No. 174.

*Primary Examiner*—Tony M. Argenbright
*Attorney, Agent, or Firm*—Cushman, Darby & Cushman

[57] ABSTRACT

In a feedback control system for air/fuel ratio control of an internal combustion engine, in which an integration correcting amount is derived from the output signal of a gas sensor indicative of the concentration of an exhaust gas component, and an engine condition correcting amount read out from a memory is arranged to be renewed in accordance with the integration correcting amount so as to effect learning correction, fuel vapor evaporated in a fuel tank is selectively fed via a canister to the engine by controlling an electromagnetic valve. When the engine is in a predetermined operational condition, the electromagnetic valve is energized to disable a fuel vapor supply system. The learning correction is performed only when the fuel vapor supply system is disabled so that the value of the engine condition correcting amount is not affected by a rich mixture caused by the fuel vapor from the canister.

17 Claims, 10 Drawing Figures

| IDLE Sw \ Q | 1 | 2 | 3 | --- | --- | n-1 | n | n+1 | --- | --- | 30 | 31 |
|---|---|---|---|---|---|---|---|---|---|---|---|---|
| ON | $K_1^1$ | $K_2^1$ | $K_3^1$ | --- | --- | $K_{n-1}^1$ | $K_n^1$ | $K_{n+1}^1$ | --- | --- | $K_{30}^1$ | $K_{31}^1$ |
| OFF | $K_1^2$ | $K_2^2$ | $K_3^2$ | --- | --- | $K_{n-1}^2$ | $K_n^2$ | $K_{n+1}^2$ | --- | --- | $K_{30}^2$ | $K_{31}^2$ |

CLOSED LOOP AIR/FUEL RATIO CONTROL OF I.C. ENGINE USING LEARNING DATA UNAFFECTED BY FUEL FROM CANISTER

BACKGROUND OF THE INVENTION

This invention relates generally to closed loop air/fuel ratio control of an internal combustion engine mounted on a motor vehicle or the like, and more particularly, the present invention relates to a method and apparatus for controlling the mixture of air and fuel supplied to internal combustion engines at a variable ratio in response to a signal derived from an exhaust gas sensor to reduce the emission of noxious components in burnt gases.

Various methods and systems for effecting air/fuel ratio control are known, and in one conventional method, a first integration corrective setting or correction factor is derived by integrating the output signal from the gas sensor, and then a second corrective setting or correction factor is derived in accordance with the first correction factor and the operating condition of the engine. The second correction factor is stored in a memory so that feedback control will be effected by determining the air/fuel ratio supplied to the engine by correcting or modifying a basic fuel flow amount, which is derived on the basis of the intake airflow and the engine speed, by the first and second correction factors. In such a known system, in which so called learning control or correction is effected, the second correction factor is apt to assume a value far deviated from its standard value due to rich mixture caused by fuel vapor supplied through the canister which collects evaporated fuel in the fuel tank.

If the engine is stopped under such condition, the data for the second correction factors remain in the memory. Therefore, when the engine is restarted after being cooled, the second correction factors, whose values are far deviated from their standard values, will be used to erroneously control the air/fuel ratio resulting in undesirable operation of the engine and emission of noxious components.

SUMMARY OF THE INVENTION

The present invention has been developed in order to remove the above-mentioned drawback inherent to the conventional closed loop air/fuel ratio control in which learning control is effected.

It is, therefore, an object of the present invention to provide a method and apparatus for controlling air/fuel ratio of the mixture supplied to an internal combustion engine so that adsorbed fuel vapor supply from the canister does not result in undesirable operation of the engine.

In order to control the air/fuel ratio so that the enngine operates in a desirable manner, fuel vapor evaporated in the fuel tank and collected in the canister is selectively fed to the intake manifold of the engine in accordance with the operational condition of the engine. Learning control, in which the second correction factor is renewed, is effected only when the engine operates under a predetermined condition. Additional fuel supply from the canistor is disabled during the learning control so that the the second correction factors provided for a plurality of subranged of engine operational conditions are prevented from assuming values which are far deviated from their standard values.

In accordance with the present invention there is provided a method for controlling air/fuel ratio in an internal combustion engine equipped with means for collecting fuel evaporated in a fuel tank and means for supplying the collected fuel vapor to the engine, comprising the step of: detecting the operational condition of the engine; and controlling the fuel vapor suppying means so that the amount of the fuel vapor fed to the engine is varied in accordance with the detected operational condition of the engine.

In accordance with the present invention there is also provided a method for controlling air/fuel ratio in an internal combustion engine equipped with a feedback control system which controles the air/fuel ratio in accordance with an output signal of a gas sensor detecting the concentration of a gas component in the exhaust gasses of the engine, the engine being equipped with an adsorbed fuel supply system which supplies the engine with fuel vapor evaporated in a fule tank, the method comprising the steps of: integrating the output signal from the gas sensor for obtaining an integration correcting amount; detecting the operational condition of the engine; disabling the adsorbed fuel supply system when the engine is in a predetermined operational codition; renewing an engine condition correcting amount read out from a memory, in which a plurality of engine condition correcting amounts are prestored, only when the adsorbed fuel supply system is disabled; storing the renewed engine condition correcting amount in the memory; and controlling the air/fuel ratio by correcting a standard value, which is obtained on the basis of the operational parameters of the engine, by the integration correcting amount and the engine condition correcting amount.

In accordance with the present invention there is further provided apparatus for controlling air/fuel ratio in an internal combustion egnine equipped with means for collecting fuel evaporated in a fuel tank and means for supplying the collected fuel vapor to the engine, comprising: first means for detecting the operational condition of the engine; and second means for controlling the fuel vapor suppying means so that the amount of the fuel vapor fed to the engine is varied in accordance with the detected operational condition of the engine.

BRIEF DESCRIPTION OF THE DRAWINGS

The object and features of the present invention will become more readily apparent from the following detailed description of the preferred embodiment taken in conjunction with the accompanying drawings in which:

FIGS. 7A and 7B are graphical illustrations of the characteristics of the second correction factors under different engine conditions.

The same or corresponding elements and parts are designated at like numerals throughout the drawings.

DETAILED DESCRIPTION OF THE INVENTION

Figure 1:
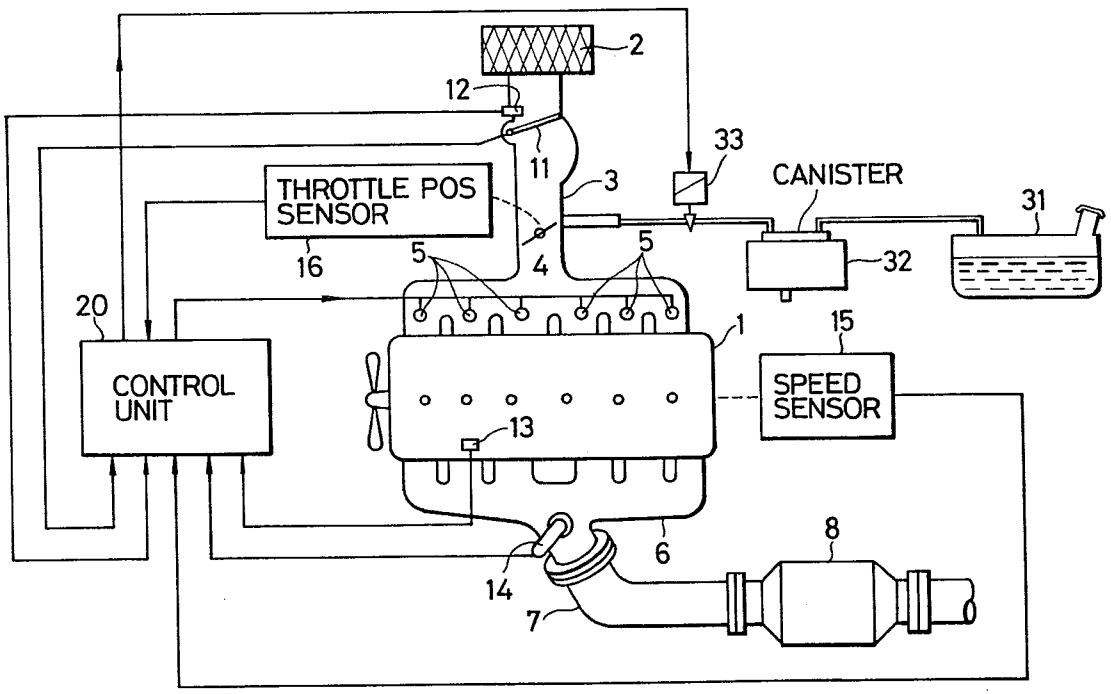
FIG. 1 is a schematic diagram of an air/fuel ratio control system according to the present invention.

FIG. 1 illustrates a closed loop or feedback air/fuel ratio control system of an internal combustion engine mounted on an automotive vehicle. An internal combustion engine 1, which functions as the prime mover of an automotive vehicle (not shown), is of well known 4-cycle spark ignition type. The engine 1 is arranged to be supplied with air via an air cleaner 2, an intake manifold 3 and a throttle valve 4. The engine 1 is also supplied with fuel, such as gasoline, from a fuel tank 31. The fuel from the fuel tank 31 is fed through an unshown fuel supplying system to fuel injection valves 5, which are electromagnetically operable. The fuel injection valves 5 are provided for respective cylinders of the engine 1 in the conventional manner. Exhuast gasses produced as the result of combustion are discharged into atmosphere through an exhaust manifold 6, an exhuast pipe 7 and a three-way catalytic converter 8.

The airflow meter 11 is equipped with an airflow meter 11 constructed of a movalbe flap and a potentiometer, the movable contact of which is operatively connected to the flap. The intake manifold 3 is equipped with a thermister type temperature sensor 12 for producing an output analog signal indicative of the temperature of the intake air. A second thermistor type temperature sensor 13 is shown to be coupled to the engine 1 for producing an output analog signal indicative of the coolant temperature.

An oxygen sensor 14, which functions as an air/fuel ratio or gas sensor, is disposed in the exhaust manifold 6 for producing an output signal indicative of the concentration of the oxygen contained in the exhaust gasses. As is well known, the oxygen concentration represents the air/fuel ratio of the air/fuel mixture supplied to the engine 1, and for instance, the output voltage of the oxygen sensor 14 is approximately 1 volt when the detected air/fuel ratio is smaller, i.e. richer, than the stoichiometric air/fuel ratio; and is approximately 0.1 volt when the detected air/fuel ratio is higher, i.e. leaner, than the same. Accordingly, the gas sensor output can be treated as a digital signal.

An engine speed sensor 15 is employed for detecting the engine rpm. Namely, the rotational speed of the engine crankshaft (not shown) is indicated by the number of pulses produced per unit time. Such a pulse train signal, i.e. a rotation synchronized signal, may be readily derived from the primary winding of the ignition coil of the ignition system (not shown).

An idling switch 16 is provided to detect when the throttle valve 4 is fully closed. Namely, the idling switch 16 functions as a throttle valve position sensor to produce an output signal when the throttle vavle is closed.

The output signals of the above-mentioned circuits, namely the airflow meter 11, the intake air temperature sensor 12, the coolant temperature sensor 13, the oxygen sensor 14, the speed (rpm) sensor 15, and the idling switch 16 are respectively applied to a control unit 20 which may be constructed of a microcomputer system.

A canister 32 is provided to absorb evaporated hydrocarbons from the fuel tank 31. The canistor 32 comprises activated charcoal therein, and is arranged to feed the fuel vapor to the intake manifold 3 at a point slightly upstream of the throttle valve 4. The above-described structure of the air/fuel ratio control system is substantially the same as the conventional one, but differs in that an electromagnetic valve 33 is provided in a pipe (no numeral) connected between the canister 32 and the intake manifold 3. The electromagnetic valve 33 is controlled by an energizing signal applied thereto as will be described later.

The control unit 20 determines the energizing period of the fuel injection valves 5 in accordance with various information applied thereto so that desired air/fuel ratio can be ensured. Furthermore, the control unit 20 produces a signal for controlling the energization of the electromagnetic valve 33 so that adsorbed fuel supply from the canistor 32 to the intake manifold 3 will be controlled in accordance with the operating condition of the engine 1.

Figure 2:
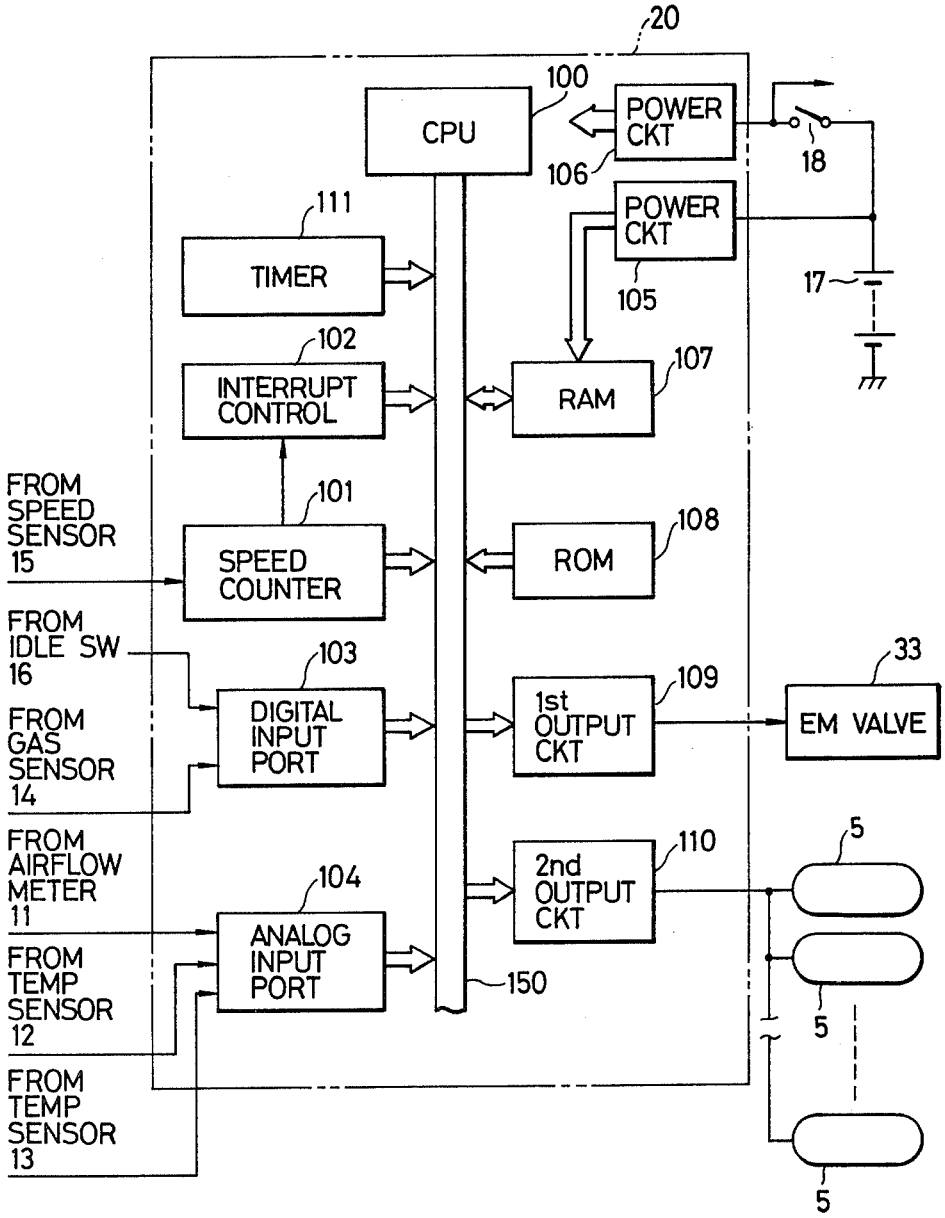
FIG. 2 is a schematic block diagram of the control unit shown in FIG. 1.

FIG. 2 illustrates a detailed block diagram of the control unit 20 shown in FIG. 1. The control unit 20 comprises a microprocessor, i.e. a central processing unit 100 (CPU), for calculating the quantity of fuel to be supplied to the engine 1 in accordance with various information applied thereto. A counter 101 for measuring the number of rotations of the engine crankshaft is responsive to the output signal of the above-mentioned speed sensor 15 to count the number of clock pulses. The counter 101 has first and second outputs respectively connected to a common bus 150 and to an input of an interrupt control unit 102 the output of which is connected to the common bus 150. With this arrangement the counter 101 is capable of supplying the interrupt control unit 102 with an interrupt instruction. In receipt of such an instruction the interrupt control unit 102 produces an interrupt signal which is fed to the CPU 100 via the common bus 150.

A digital input port 103 is provided for receiving digital signals from the air/fuel ratio sensor 14 and from a idling switch 16. These digital signals are applied via the common bus 150 to the CPU 100. An analog input port 104, which is constructed of an analog multiplexer and an A/D converter, is used to convert analog signals from the airflow meter 11, the intake air temperature sensor 12, and from the coolant temperature sensor 13 in a sequence, and then to deliver the converted signals via the common bus 150 to the CPU 100.

A first power supply circuit 105 receives electric power from a power source 17, such as a battery mounted on the motor vehicle. This first power supply circuit 105 supplies a RAM 107, which will be described hereinlater, with electrical power, and is directly connected to the power source 17 rather than through a switch. A second power supply circuit 106 is, however, connected to the power source 17 via a switch 18, which may be an ignition key or a switch controlled by the ignition key. The second power supply circuit 106 supplies all of the circuits included in the control unit 20 except for the RAM 107.

The RAM 107 is used to temporarily store various data during the operations of the CPU 100. Since the RAM 107 is continuously fed with electrical power from the power source 17 through the first power supply circuit 105, the data stored in the RAM 107 are not erased or cancelled although the ignition key 18 is turned off to stop the engine operation. Namely, this RAM 107 can be regarded as a nonvolatile memory. Data indicative of second correction factors K2, which will be described later, will be stored in the RAM 107. The RAM 107 is coupled via the common bus 150 to the CPU 100 so that various data will be written in and read out from the RAM 107 as will be described hereinlater.

A read-only memory (ROM) 108 is connected via the common bus 150 to the CPU 100 for supplying the same with an opeational program and various constants. As is well known, the data or information contained in the ROM 108 has been prestored therein in nonerasable form when manufacturing so that the data can be maintained as they are irrespective of the manipulatin of the ignition key 18.

A first output circuit 109 including a down counter, registers and a power transistor is provided for producing a driving current in the form of a pulse train signal with which the fuel injection valves 5 are energized successively. The width of the pulse signal corresponds to the quantity of fuel to be supplied to the engine 1 so that fuel flow rate will be controlled by changing the pulse width. The first output 109 is coupled via the common bus 150 to the CPU 100 for receiving digital signals indicative of the quantity of fuel which should be fed to the engine 1. Namely, the counter in the first output circuit 109 converts its digital input into a pulse train signal, the pulse width of which is varied by the digital input, so that fuel injectin valves 5 are sucessively energized for an interval defined by the pulse width to inject fuel into the intake manifold 3.

A second output circuit 110 comprises a latch, a power transistor etc for producing a driving current applied to the electromagnetic valve 33. Namely, the second output circuit 110 is responsive to digital data from the CPU 100 for selectively energizing or deenergizing the electromagnetic valve 33 with which the above-mentioned adsorbed fuel vapor from the canister 32 is selectively fed to the intake manifold 3.

A timer circuit 111 is connected via the common bus 150 to the CPU 100 for supplying the same with information of laps of time measured. Namely, the timer circuit 111 comprises a clock generator for supplying the CPU 100 with clock pulses, and a counter for couting the number of clock pulses to indicate the laps of time.

The rotation number counter 101 measures the number of rotations of the engine crankshaft once per a revolution of the engine crankshaft by counting the number of pulses from the engine rotational speed sensor 15. The aforementioned interrupt instruction is produced at the end of each measurement of the engine speed. In response to the interrupt instruction the interrupt control unit 102 produces an interrupt signal which will be fed to the CPU 100. Accordingly, the running program stops to execute an interrupt routine.

Figure 3:
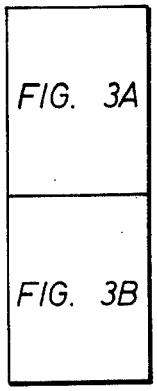
FIGS. 3, 3A and 3B are flowcharts showing the operational steps of the central processing unit shown in FIG. 2.
Figure 3A:
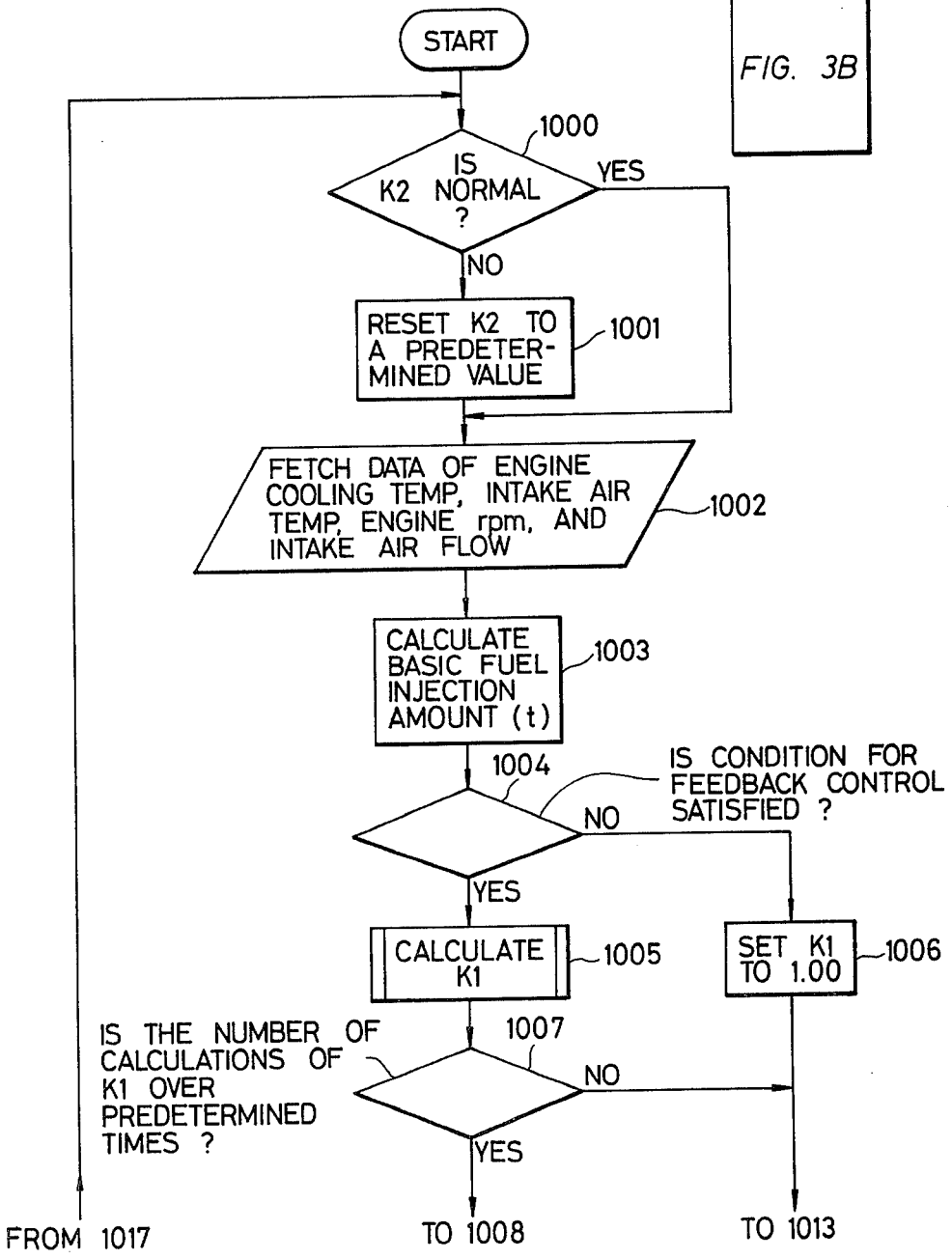
Figure 3B:
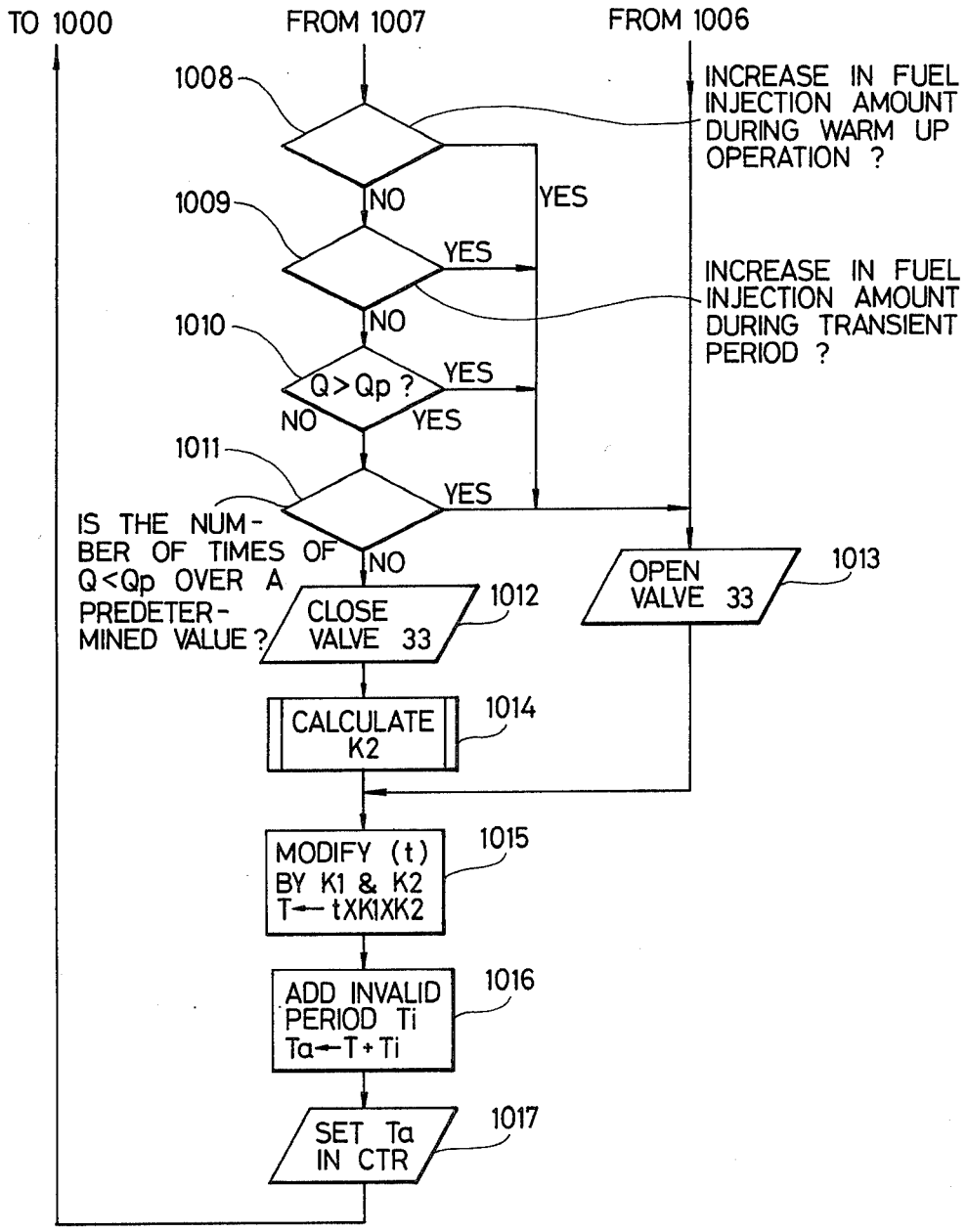

FIG. 3 is a flowchart showing briefly operational steps of a main routine for the CPU 100, and the function of the CPU 100 as well as the operation of the system of FIG. 2 will be described with reference to this flowchart. The engine 1 starts running when the ignition key 18 is turned on. The control unit 20 is thus energized so that the CPU 100 starts executing the steps in the main routine. In a following step 1000, it is detected or decided whether a second correction factor K2, which will be described later, satisfies a predetermined normal condition. When the value of the second correction factor K2 is normal, i.e. the value is within a predetermined range, a following step 1002 takes place so that digital data of the coolant temperature, the intake air temperature and the the intake airflow applied from the analog input port 104 are stored in the RAM 107. On the other hand, when the value of the second correction factor K2 is out of the predetermined range, the value is regarded as abnormal, and therefore, a resetting step 1001 takes place to reset the value of the second correction factor K2 to a predetermined value. When the step 1001 is completed, namely when K2 is reset, the step 1002 takes place in the same manner. Then in a following step 1003, a basic quantity of fuel to be injected, defined by the energizing period of each injection valve 5, is calculated on the basis of the rotational speed N and the intake airflow Q which are represented by the analog signals taken through the analog input port 104.

The energing period of time (t) will be calculated by using the folloing formula:

$$t=F\times Q/N$$

wherein F is a constant:

In a following step 1004, it is decided whether condition for performing feedback control of the air/fuel ratio is satisfied or not by checking various input signals, such as signals indicative of the opening degree of the throttle valve 4 and the coolant temperature. If the condition is satisfied, a step 1005 takes place, and on the other hand, a step 1006 takes place when unsatisfied. In the step 1005, a first correction factor K1, which will be described later, is either increased or decreased by processing the output signal from the gas sensor 14 fed through the digital input port 103. A new value of K1 obtained in this way will be stored in the RAM 107. In the step 1006, the first correction factor is reset to 1.00.

Figure 4:
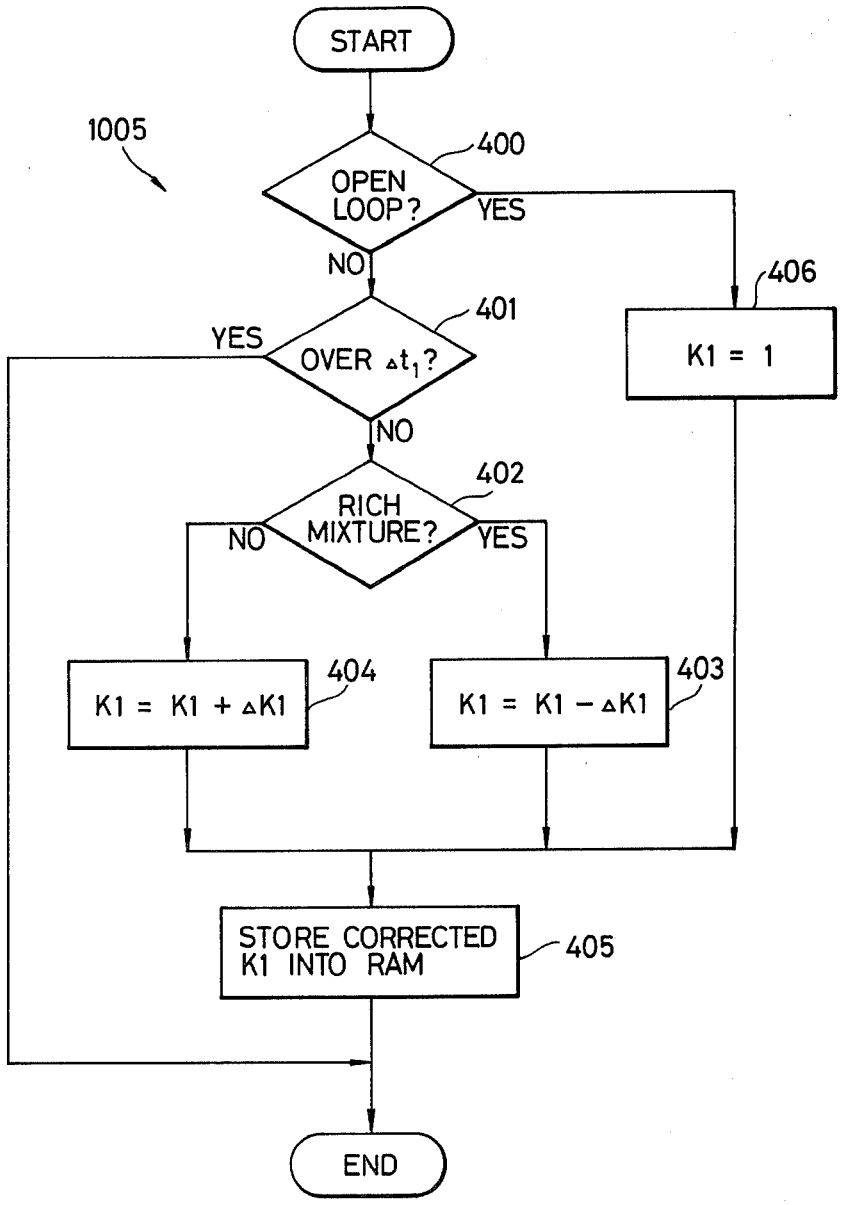
FIG. 4 is a detailed flowchart of the step for processing a first correction factor (integration correcting amount), which step is shown in FIG. 3.

FIG. 4 illustrates a detailed flowchart for obtaining the first correction factor K1. Namely, the flowchart of FIG. 4 shows substeps included in the step 1005 of FIG. 3, where the substeps are used to either increase or decrease, i.e. to integrate, the first correction factor K1 (integration correcting amount). In a step 400, it is detected whether the feedback control system is in an open loop condition or in a closed loop condition. In order to detect such a state of the feedback control system, it is detected whether the air/fuel ratio sensor 14 is active or not. This step 400, however, may be replaced with a step of detecting whether the coolant temperature or the like is above a given level so that a feedback control can be performed. When a feedback control cannot be performed, i.e. when the feedback control system is in an open loop conditon, a following step 406 takes place to set as K1=1, then entering into a following step 405.

On the other hand, when a feedback control can be performed, a step 401 takes place to detect whether the lapse of time measured has exceeded unit time $\Delta t1$. If the answer of the step 401 is NO, the operation of the step 1004 terminates. If the answer of this step 401 is YES, i.e. when the measured lapse of time has exceeded the unit time $\Delta t1$, a following step 402 takes place to see whether the output signal of the air/fuel ratio sensor 14 indicates that the air/fuel mixture is rich or not. Assuming that a high level outut signal of the air/fuel ratio sensor 14 indicates a rich mixture, when such a high level output signal is detected, the operational flow enters into a step 403 in which the value of K1, which has been obtained in the prior cycle, is reduced by $\Delta K1$. On the contrary, when the air/fuel mixture is detected to be lean, namely when the output signal of the air/fuel ratio sensor 14 is low, a step 404 takes place to increase the value of K1 by ΔK1. After the value of K1 is either increased or decreased as mentioned in the above, the aforementioned step 405 takes place to store the renewed value of K1 into the RAM 107.

Turning back to FIG. 3, a step 1007 follows the step 1005 which has been described in detail with reference to FIG. 4. In the step 1007, it is detected whether calculation or renewals of the value of K1 have been performed a predetermined number of times. This step 1007 is performed so that learning correction of the second correction factor K2 will be effected a predetermined period of time after the first correction factor K1 is renewed. If renewals have been performed the predetermined number of times, a step 1008 takes place. On the other hand, if the number of renewals has not reached the predetermined number, a step 1013 takes place. The step 1013 is arranged to be performed when the above-mentioned step 1006 has been completed.

In the step 1008, it is detected whether the fuel injection amount is being increased during the start up or warming up operation of the engine 1. If the fuel injection amount is being increased, the step 1013 takes place. On the contrary, if the fuel injection amount is not being increased, a step 1009 takes place in which it is detected whether the fuel injection amount is being increased during a transient period in engine operational condtion. It is meant by the transient period that the engine is accelerating or decelerating. Such a transient period can be detected by monitoring the output signal from the idling switch 16 or the engine rotational speed. If the answer of the step 1009 is YES, the step 1013 takes place. On the other hand, if the answer of the step 1009 is NO, namely when it is detected that fuel injection amount is not being increased during the transient period, a step 1010 takes place, in which it is detected whether the intake airflow Q is greater than a predetermined value Qp. If the answer of the step 1010 is YES, the step 1013 takes place. On the other hand, if the answer of the step 1010 is NO, namely, when the intake airflow Q is not greater than the predetermined value Qp, a step 1011 takes place in which it is detected whether the number of times of detections that intake airflow Q is smaller than the predetermined value Qp exceeds a predetermined number. If the answer of the step 1011 is YES, the step 1013 takes place. On the other hand, if the answer of the step 1011 is NO, namely, when the number of times of detections of low intake airflow is smaller than the predetermined number, a step 1012 takes place. From the above it will be understood that the step 1012 takes place only when four conditions checked in the stpes 1008, 1009 and 1010 are satisfied. In other words, the step 1012 is performed only when the engine is in a predetermined operating condition defined by various condition checking factors of the steps 1008 to 1010. The predetermined condition detected by these three steps 1008 to 1010 corresponds to a steady state of the engine 1. The step 1011 is performed so that learning correction of the second correction factor K2 will be effected a predetermined period of time after the engine is put in the steady state because it is not desirable to effect learning correction immediately after the engine is put is the steady state. Although the number of engine operational conditions to be satisfied prior to performing the step 1012 is three, i.e. steps 1008 to 1010, in this embodiment, the number of conditions may be changed if desired.

The steps 1012 and 1013 are used to control the energization of the electromagnetic valve 33 which controls the adsorbed fuel vapor supply from the canistor 32 to the intake manifold 3. Namely, in the step 1013, the second output circuit 110 of FIG. 2 is controlled to cause the electromagnetic valve 33 to open, and on the other hand, in the step 1012, the second output circuit 110 is controlled so that the electromagnetic valve 33 closes. Suppose the electromagnetic valve 33 is arranged to be closed in receipt of a driving signal, the second output circuit 110 produces such a driving signal only when the step 1012 takes place.

A step 1014 for changing the value of the second correction factor K2 will be performed only when the step 1012 is completed. The step 1014 is provided for performing so called learning correction which is known in the conventional air/fuel ratio control systems. Since the step 1014 for learning correction of K2 is performed after the electromagnetic valve 33 is closed, learning correction will be performed during a period of time in which the adsorbed fuel vapor from the canistor 32 is not fed to the intake manifold 3. With this operation, the operational condition of the engine 1 is prevented from being changed or influenced by the adsorbed fuel vapor supply from the canistor 32 so that learning correction will be performed desirably as will be described later. The steps from 1004 to 1011 are provided for detecting whether conditions for performing learning correction are satisfied or not. When one of the conditions is not satisfied, the step 1013 takes place to allow the evaporated fuel, which is adsorbed in the canister 32, to be fed to the intake manifold 3.

Figure 5:
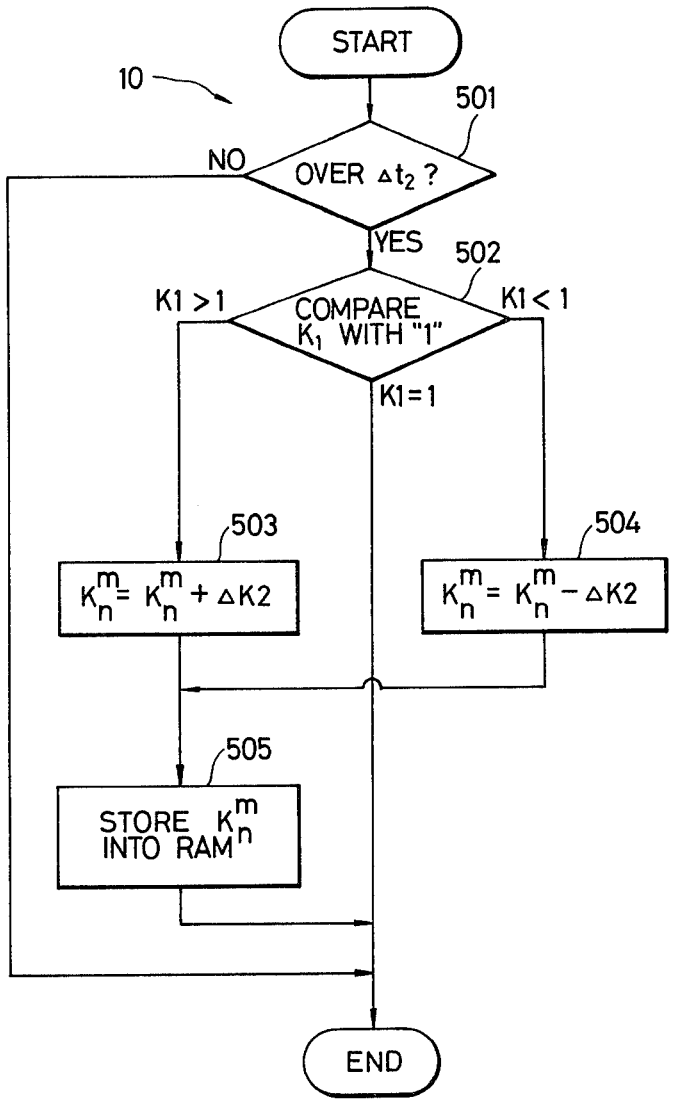
FIG. 5 is a detailed flowchart of the step for processing a second correction factor, which step is also shown in FIG. 3.

FIG. 5 is an illustration of a detailed flowchart for performing learning correction with respect to the second correction factor K2 (engine condition correcting amount), and the operation of K2 will be described with reference to FIG. 5.

In a step 501, it is detected whether the lapse of time, which is measured from the instant of detection of the variation of the air/fuel ratio sensor output from one state indicative of a rich mixture to the other state indicative of a lean mixture or vice versa, has exceeded a second unit time Δt2 or not. If the measured period has exceeded the unit time Δt2, the step of 1014 ends. On the other hand, if the period has not exceeded the unit time Δt2, a following step 502 takes place. In this step 502, the value of the first correction factor K1 is detected, and if K1=1, no further step will take place to end the step 1014.

Figure 6:
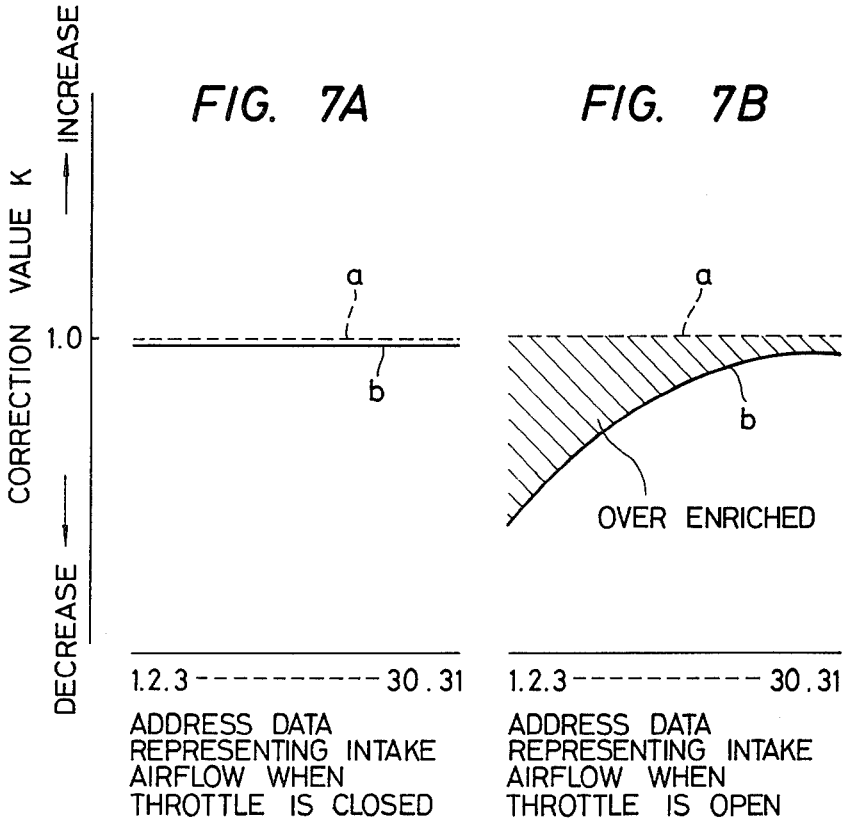
FIG. 6 is a map of the second correction factors stored in the memory shown in FIG. 2.

The second correction factor K2 is related to the operational condition of the engine 1. In detail, a number of second correction factors K2 constitute a map in the RAM 107 in such a manner that each of the second correction factors K2 corresponds to various values of the intake airflow Q as shown in a table of FIG. 6. In detail, thirty-one second correction factors are provided respectively for first and second groups so as to correspond to respective subranges of the intake airflow Q. The first group second correction factors, which are shown in the column of ON in FIG. 6, are for a condition in which the idling switch 16 (see FIG. 1) produces an output signal indicative of the substantially closed state of the throttle valve 4, while the second group correction factors, which are shown in the column of OFF, are for an opposite condtion.

Each of the second correction factors K2 is expressed in terms of $K_n^m$, where those of the first group (ON) are designated by $K_n^1$, and those of the second group (OFF) by $K_n^2$. Therefore, a second correction factor K2 corresponding to an "n"th value in the sequence of the subranges of the intake air quantity Q and to an ON state of the idling switch 16 is expressed in terms of $K_n^1$.

In the step 502, if K1>1, a step 503 takes place, and on the other hand, if K1<1, a step 504 takes place. In the steps 503 and 504, the value of the second corretion factor $K_n^m$ read out from a given address of the RAM 107 is added or subtracted by ΔK2. After the addition or subtraction in the step 503 or 504, a step 505 takes place in which a new value of the second correction factor $K_n^m$ obtained as the result of addition or subtraction is stored in the RAM 107. Namely, the second correction factor K2 has been renewed in the step 503 or 504, and then the step 1014 ends. After the completion of the step 1014, a step 1015 of FIG. 3 takes place.

Turning back to FIG. 3, it will be described how the air/fuel ratio of the mixture supplied to the engine 1 is controlled in accordance with the present invention. In order to determine the energizing or opening period of time of each of the fuel injection valves 5, the energizing period (t) obtained in the step 1003 is corrected by updated or renewed values of the first and second correction factors K1 and K2. Namely, the energizing period (t) is multiplied by K1 and K2. To this end, the energizing interval (t) and the first and second correction factors K1 and K2 all stored in the RAM 107 are read out, and then a desired opening or injecting interval T will be calculated by the formula given below:

$$T=t\times K1\times K2$$

The opening interval T, which has been obtained as the result of the above-mentioned calculation, is then stored in the RAM 107, and then a step 1016 takes place in which the value of T is added by Ti corresponding to an invalid injecting period so as to obtain finally an actual energizing period Ta. The addition of the invalid injecting period Ti is performed to compensate for time lag inherent to the fuel injection valves 5. The value of Ta is then set in the counter of the first output circuit 109, in a following step 1017, so as to effect pulse width modulation in connection with the pulse applied to the drive circuit. Each of the injection valves 5 will be energized for the opening inteval Ta in receipt of each pulse from the first output circuit 109 to inject a given quantity of fuel defined by the interval Ta.

After the step 1017, the operational flow returns to the first step 1000 of the main routine. In the main routine, the step 1013 takes place even if the step 1005 is performed. Therefore, the electromagnetic valve 33 is energized so that the fuel vapor in the canister 32 is fed to the intake manifold. When the step 1013 is performed, the steps 1012 and 1014 are skipped. Namely, learning correction of the second correction factor K2 is not performed as long as the electromagnetic valve is open.

Although the above-described embodiment is an example of air/fuel ratio control by controlling the actuating interval of fuel injection valves of an electronic fuel injection system, the air/fuel ratio may be controlled by other ways. For instance, in an internal combustion engine equipped with a carburettor, the quantity of fuel supplied to the carburettor and/or the quantity of air bypassing the carburettor may be controlled. Furthermore, the quantity of secondary air supplied to the exhaust system of an engine may be controlled so that the concentration of a gas component included in the gasses applied to the following catalytic converter is desirably controlled as if the air/fuel ratio of the mixture supplied to the engine were controlled to a desired value.

From the foregoing description, it will be understood that a suitable correcting amount can be used instantaneously inasmuch as many second correction factors K2, i.e. $K_n^m$ corresponding to various values of the intake air quantity Q are provided. Thus, the control of air/fuel ratio can be effected with quick response with respect to any operating conditions including transient conditions of the engine 1. Furthermore, in the case that the first correction factor (integration correcting amount) K1 has been undesirably shifted or deviated on abnormal conditions of the air/fuel ratio sensor 14 etc, only a small amount of the correction of the second correction factor K2 is required. In the case that the engine operational condition is not suitalbe for feedback control, the first correction factor K1 is set to 1 (see step 1006 in FIG. 3), and in this case the second correction factor K2 is not changed. Therefore, the air/fuel ratio to be controlled is prevented from drastically deviating from a desired value or point by using such a value of K1 and a prestored value of K2.

FIGS. 7A and 7B are graphic illustrations of the relationships beween the second correction factors K2 and the intake air flow rate Q for different engine operating conditons in which the throttle valve is closed or open. The second correction factors K2, which are used when the throttle is substatially closed, is manintained at 1.0 regardless of the intake airflow rate as indicated by straight lines (a) and (b) in FIG. 7A because no adsorbed fuel vapor is supplied from the canister 32 when the throttle is subtantially closed. The line (b) represents the variation of K2 value in the conventional system, while the other line (a) represents the same in the embodiment of the present invention.

In the coventional system, in which learning correction of K2 is effected irrespective of the supply of the adsorbed fuel vapor from the canistor 32, when the throttle valve 4 is open, the K2 value assumes a value other than 1.00 as indicated by a curve (b) in FIG. 7B so as to compensate for over-enrichment (as indicated by the hatched-area in FIG. 7B) which arises due to the fact that a high vacuum in the intake manifold 3 causes an increase in fuel vapor supplied to the engine 1. According to the present invention, however, learning correction of the second correction factor K2 is not effected when the adsorbed fuel vapor is supplied from the canistor 32. In other words, learning correction, i.e. the step 1014 in FIG. 3, is effected after the electromagnetic valve 33 is closed so that no undesirable influence is given to the learning operation of K2. As a result, the value of K2 is maintained at 1.00 irrespective of the flow rate of the intake air as indicated by the straight line (a) in FIG. 7B.

From the foregoing description it will be understood that each value of the second correction factors K2, which are arranged to be renewed in accordance with the variation of the first correction factor K1 in the learning correction of step 1014, is maintained at a value obtained in a former cycle of the learning correction which has been performed after the electromagnetic valve 33 was closed. Such a value of K2 for each subrange of the airflow rate Q is stored in the RAM 107 to form the map of FIG. 6. Therefore, there is no fear that a value of K2, which is far deviated from 1.00, is stored in the RAM 107 even if the ignition key 18 of FIG. 1 is turned off. Accordingly, when the ignition key 18 is turned on again after the engine 1 is cooled, the prestored data of K2, which have not been influenced by the rich mixture due to the adsorbed fuel vapor from the canitor 32, will be used to control the air/fuel ratio in a desirable manner.

The above-described embodiment is just an example of the present invention, and therefore, it will be apparent for those skilled in the art that many modifications and variations may be made without departing from the spirit of the present invention.

What is claimed is:

1. A method for controlling air/fuel ratio in an internal combustion engine equipped with a feedback control system which controls the air/fuel ratio in accordance with an output signal of a gas sensor detecting the concentration of a gas component in the exhaust gasses of said engine, said engine being equipped with an adsorbed fuel vapor supply system which supplies said engine with fuel vapor evaporated in a fuel tank, said method comprising the steps of:

(a) integrating said output signal from said gas sensor for obtaining an integration correcting amount;

(b) detecting the operational condition of said engine;

(c) disabling said adsorbed fuel vapor supply system when said engine is in a predetermined operational condition;

(d) renewing an engine condition correcting amount read out from a memory, in which a plurality of engine condition correcting amounts are prestored, only when said adsorbed fuel supply system is disabled;

(e) storing the renewed engine condition correcting amount in said memory; and (f) controlling the air/fuel ratio by correcting a standard value, which is obtained on the basis of the operational parameters of said engine, by said integration correcting amount and said engine condition correcting amount.

2. A method as claimed in claim 1, wherein said step of renewing is performed for a predetermined period of time after said engine is put in said predetermined operational contidion.

3. A method for controlling air/fuel ratio in an internal combustion engine as claimed in claim 1, wherein said adsorbed fuel supply system is enabled after the completion of said step of renewing.

4. A method as claimed in claim 3, wherein said step of renewing is not executed when said adsorbed fuel supply system is enabled.

5. A method as claimed in claim 1, wherein said step of renewing is performed only when a predetermined period of time has elapsed after the instant of variation of said output signal of said gas sensor from its one state indicative of a rich mixture to the other state indicative of a lean mixture or vice versa.

6. A method as claimed in claim 1, wherein said step of detecting comprises a step of detecting when the fuel is being increased during a transient operational condition of said engine.

7. A method as claimed in claim 1, wherein said step of detecting comprises a step of detecting when the fuel is being increased during a warm up operation of said engine.

8. A method as claimed in claim 1, wherein said step of detecting comprises a step of detecting when the intake airflow is smaller than a predetermined value.

9. A method as claimed in claim 1, wherein said step of detecting comprises a step of detecting when the opening degree of the throttle valve of said engine is smaller than a predetermined value.

10. A method for controlling air/fuel ratio in an internal combustion engine as claimed in claim 1, wherein said step of controlling the air/fuel ratio is executed only when the air/fuel ratio is being controlled with a feedback operation.

11. A method for controlling air/fuel ratio in an internal combustion engine as claimed in claim 1, wherein said step of detecting comprises a step of detecting when said engine is in warming up condition.

12. A method for controlling air/fuel ratio in an internal combustion engine as claimed in claim 1, wherein said step of detecting comprises a step of detecting when said engine is in high-load condition.

13. Apparatus for controlling air/fuel ratio in an internal combustione engine equipped with a feedback control system which controls the air/fuel ratio in accordance with an output signal of a gas sensor detecting the concentration of a gas component in the exhaust gasses of said engine, said engine being equipped with an adsorbed fuel vapor supply system which supplies said engine with fuel vapor evaporated in a fuel tank, said apparatus comprising:

(a) first means for integrating said output signal from said gas sensor for obtaining an integration correcting amount;

(b) second means for detecting the operational condition of said engine;

(c) third means responsive to said second means for disabling said adsorbed fuel vapor supply system when said engine is in a predetermined operational codition;

(d) fourth means for renewing an engine condition correcting amount read out from a memory, in which a plurality of engine condition correcting amounts are prestored, only when said adsorbed fuel supply system is disabled;

(e) fifth means for storing the renewed engine condition correcting amount in said memory; and (f) sixth means for controlling the air/fuel ratio by correcting a standard value, which is obtained on the basis of the operational parameters of said engine, by said integration correcting amount and said engine condition correcting amount.

14. Apparatus as claimed in claim 13, wherein said second means comprises a coolant temperature sensor for detecting the temperaure of the engine coolant.

15. Apparatus as claimed in claim 13, wherein said second means comprises a throttle valve opening degree sensor for detecting the opening degree of the throttle valve of said engine.

16. Apparatus as claimed in claim 13, wherein said second means comprises means for detecting when said engine is in a transient condition.

17. Apparatus as claimed in claim 13, wherein said third means comprises an electromagnetic valve for selectively supplying fuel vapor collected in a canister to said engine.

* * * * *